US005671472A

United States Patent [19]

Snelling

[11] Patent Number: 5,671,472

[45] Date of Patent: Sep. 23, 1997

[54] XEROGRAPHIC SYSTEMS USING PIEZOELECTRIC INTERMEDIATE BELT TRANSFER

[75] Inventor: Christopher Snelling, Penfield, N.Y.

[73] Assignee: Xerox Corporation, Stamford, Conn.

[21] Appl. No.: 670,831

[22] Filed: Jun. 24, 1996

[51] Int. Cl.[6] ..... G03G 15/01; G03G 15/16

[52] U.S. Cl. ..... 399/308; 399/302; 430/126

[58] Field of Search ..... 399/302, 297, 399/298, 308, 121, 313, 318; 430/48, 126

[56] References Cited

U.S. PATENT DOCUMENTS

| | | | |
|---|---|---|---|
| 3,862,848 | 1/1975 | Marley | 399/313 X |
| 3,893,761 | 7/1975 | Buchan et al. | 399/308 |
| 3,957,367 | 5/1976 | Goel | 399/302 |
| 4,341,455 | 7/1982 | Fedder | 399/308 |
| 4,682,880 | 7/1987 | Fujii et al. | 399/302 |
| 5,199,140 | 4/1993 | Valiulis | 24/545 |
| 5,243,392 | 9/1993 | Berkes et al. | 399/308 |
| 5,520,977 | 5/1996 | Snelling | 399/313 X |
| 5,572,304 | 11/1996 | Seto et al. | 399/318 X |

OTHER PUBLICATIONS

Davidson, J. R.; "Color Xerography With Intermediate Transfer"; X. Disc. Journal Jul. 1976; vol. 1, No. 7; p. 29.

*Primary Examiner*—S. Lee

*Attorney, Agent, or Firm*—William A. Henry, II

[57] ABSTRACT

Piezoelectric properties of materials, such as, polyvinylidene fluoride (PVDF) are used to generate surface potentials that are adequate for the xerographic transfer function. A web of PVDF is used to form a transfer intermediate belt. The magnitude and direction of fields generated around the belt can be controlled by judicious location of field neutralizing devices and the direction, location and magnitude of the belt strain. Toner images are first transferred onto the belt and then transferred from the belt onto copy sheets without the need for high voltage power supplies.

15 Claims, 3 Drawing Sheets

XEROGRAPHIC SYSTEMS USING PIEZOELECTRIC INTERMEDIATE BELT TRANSFER

BACKGROUND OF THE INVENTION

Cross reference is made to copending and commonly assigned U.S. application Ser. No. 08/282,588, U.S. Pat. No. 5,520,977 by Christopher Snelling and entitled "Self Biasing Transfer Roll", and U.S. patent application Ser. No. 08/283,337 by Christopher Snelling and entitled "Self Biasing Charging Member".

The present invention is directed to an imaging method and apparatus and, in particular, it is directed to an imaging method and apparatus wherein electrostatic latent images are formed on imaging members where they are rendered visible with toner particles, followed by transfer of the toner images to an intermediate transfer member followed by transfer with very high efficiency to a permanent substrate.

Imaging processes wherein a developed image is first transferred to an intermediate transfer means and subsequently transferred from the intermediate transfer means to a substrate are known. For example, U.S. Pat. No. 3,862,848 (Marley), discloses an electrostatic method for the reproduction of printed matter in which an electrostatic latent image is developed by the attraction of electroscopic marking particles thereto and is then transferred to a first receptor surface by the simultaneous application of contact and a directional electrostatic field of a polarity to urge the marking particles to the receptor surface, with the image then being transferred from the first receptor surface to a second receptor surface by the simultaneous application of contact and a directional electrostatic field of opposite polarity to urge the marking particles to the second receptor surface.

In addition, U.S. Pat. No. 3,957,367 (Goel), discloses a color electrostatographic printing machine in which successive single color powder images are transferred, in superimposed registration with one another, to an intermediary. The multi-layered powder image is fused on the intermediary and transferred therefrom to a sheet of support material, forming a copy of the original document.

Further, U.S. Pat. No. 4,341,455 (Fedder), discloses an apparatus for transferring magnetic and conducting toner from a dielectric surface to plain paper by interposing a dielectric belt mechanism between the dielectric surface of an imaging drum and a plain paper substrate such that the toner is first transferred to the dielectric belt and subsequently transferred to a plain paper in a fusing station. The dielectric belt is preferably a material such as Teflon or polyethylene to which toner particles will not stick as they are fused in the heat-fuser station.

U.S. Pat. No. 3,893,761 (Buchan et al.), discloses an apparatus for transferring non-fused xerographic toner images from a first support material, such as a photoconductive insulating surface, to a second support material, such as paper, and fusing the toner images to the second support material. Such apparatus includes an intermediate transfer member having a smooth surface of low surface free energy below 40 dynes per centimeter and a hardness of from 3 to 70 durometer. The intermediate transfer member can be, for example, a 0.1 to 10 mil layer of silicone rubber or a fluoroelastomer coated onto a polyimide support. The member can be formed into belt or drum configuration. Toner images are transferred from the first support material to the intermediate transfer member by any conventional method, preferably pressure transfer. The toner image is then heated on the intermediate transfer member to at least its melting point temperature, with heating preferably being selective. After the toner is heated, the second support material is brought into pressure contact with the hot toner whereby the toner is transferred and fused to the second support material.

U.S. Pat. No. 4,682,880 (Fuji et at.), discloses a process wherein an electrostatic latent image is formed on a rotatable latent image bearing member and is developed with a developer into a visualized image. The visualized image is transferred by pressure to a rotatable visualized image bearing member. The steps are repeated with different color developers to form on the same visualized image bearing member a multi-color image which corresponds to one final image to be recorded. The latent image bearing member and the visualized image beating member form a nip therebetween through which a recording material is passed so that the multi-color image is transferred all at once to a recording material.

"Color Xerography With Intermediate Transfer," J. R. Davidson, Xerox Disclosure Journal, Vol. 1, No. 7, page 29 (July 1976), the disclosure of which is incorporated herein by reference, discloses a xerographic development apparatus for producing color images. Registration of the component colors is improved by the use of a dimensionally stable intermediate transfer member. Component colors such as cyan, yellow, magenta, and black are synchronously developed onto xerographic drums and transferred in registration onto the dimensionally stable intermediate transfer member. The composite color image is then transferred to a receiving surface such as paper. The intermediate transfer member is held in registration at the transfer station for transferring images from the xerographic drams to the member by a hole-and-sprocket arrangement, wherein sprockets on the edges of the drums engage holes in the edge of the intermediate transfer member.

U.S. Pat. No. 5,243,392 (Berkes et at.) assigned to the same assignee as the instant application discloses an imaging apparatus and a process wherein an electrostatic latent image is formed on an imaging member and developed with a toner, followed by transfer of the developed image to an intermediate transfer element and subsequent transfer with very high transfer efficiency of the developed image from the intermediate transfer element to a permanent substrate, wherein the intermediate transfer element has a charge relaxation time of no more than about $2\times10^2$ seconds.

U.S. Pat. No. 5,119,140 (Berkes et al.) discloses a method and apparatus wherein efficient transfer of low toner masses from an intermediate image receiving member without degradation of high toner mass transfer is accomplished by using DC pretransfer corotron treatment of the intermediate followed by biased roll transfer to plain paper. Incorporation by reference is hereby made of all of the above-mentioned references to the extent necessary to practice the present invention.

Intermediate transfer elements employed in imaging apparatuses in which a developed image is first transferred from the imaging member to the intermediate and then transferred from the intermediate to a substrate should exhibit both good transfer of toner material from the imaging member to the intermediate and very good transfer of toner material from the intermediate to the substrate. Very good transfer occurs when most or all of the toner material comprising the image is transferred and little residual toner remains on the surface from which the image was transferred. Very good transfer is particularly important when the imaging process entails generating full color images by sequentially generating and developing images in each primary color in succession and superimposing the primary color images onto each other on the intermediate, since undesirable shifting or color deterioration in the final colors obtained can occur when the primary color images are not efficiently transferred from the intermediate to the substrate (paper).

Although known methods and materials are suitable for their intended purposes, a need remains for imaging apparatuses and methods employing intermediate transfer elements with high transfer efficiency to a final substrate. This is especially true of the need for transfer systems that eliminate high voltage power supplies and their attendant costs. In addition, there is a need for imaging apparatuses and methods employing intermediate transfer elements that enable generation of full color images with high color fidelity.

BRIEF SUMMARY OF THE INVENTION

The present invention discloses a tandem color printing apparatus and method wherein efficient transfer of toner images over a broad toner mass range (i.e. 0 to 3 mg/cm$^2$) from an intermediate to plain paper is accomplished. Known methods of toner image transfer, for example, Biased Roll Transfer (BRT) provide for efficient transfer of high toner mass images from an intermediate to paper but are highly inefficient in the transfer of low toner mass images and are costly and carry a size penalty.

Xerographic color copiers or printers which use tandem engines with an intermediate have a tremendous advantage in high throughput for modest process speeds. A further advantage can be found in simpler paper handling requirements. The main disadvantage is that a plurality of transfer steps are required. The last transfer step is especially critical in that a very high and uniform transfer efficiency needs to be maintained over an extremely broad toner mass range (0 to 3 mg/cm$^2$) to preclude color shifting. Color shifting refers to color deterioration due to incomplete toner transfer.

In the process of transferring a plurality of images from separate imaging structures to an intermediate, a high percentage of wrong sign toner is created with a particularly high proportion of wrong sign toner for low toner masses. This is due to the air breakdown phenomenon occurring during stripping of the intermediate from the individual imaging structures. Each time stripping occurs more toner is converted to the wrong sign. The high percentage of wrong sign toner results in the problem of inefficient transfer of low mass toner images from the intermediate to the final substrate, plain paper.

High toner transfer efficiency of low toner masses without degradation of high toner mass transfer efficiency is effected according to the present invention, by using a piezoelectric polymer device as an intermediate member that generates electrostatic fields suitable for xerographic imaging process steps including toner transfer to plain paper.

DETAILED DESCRIPTION OF THE INVENTION

Figure 1:
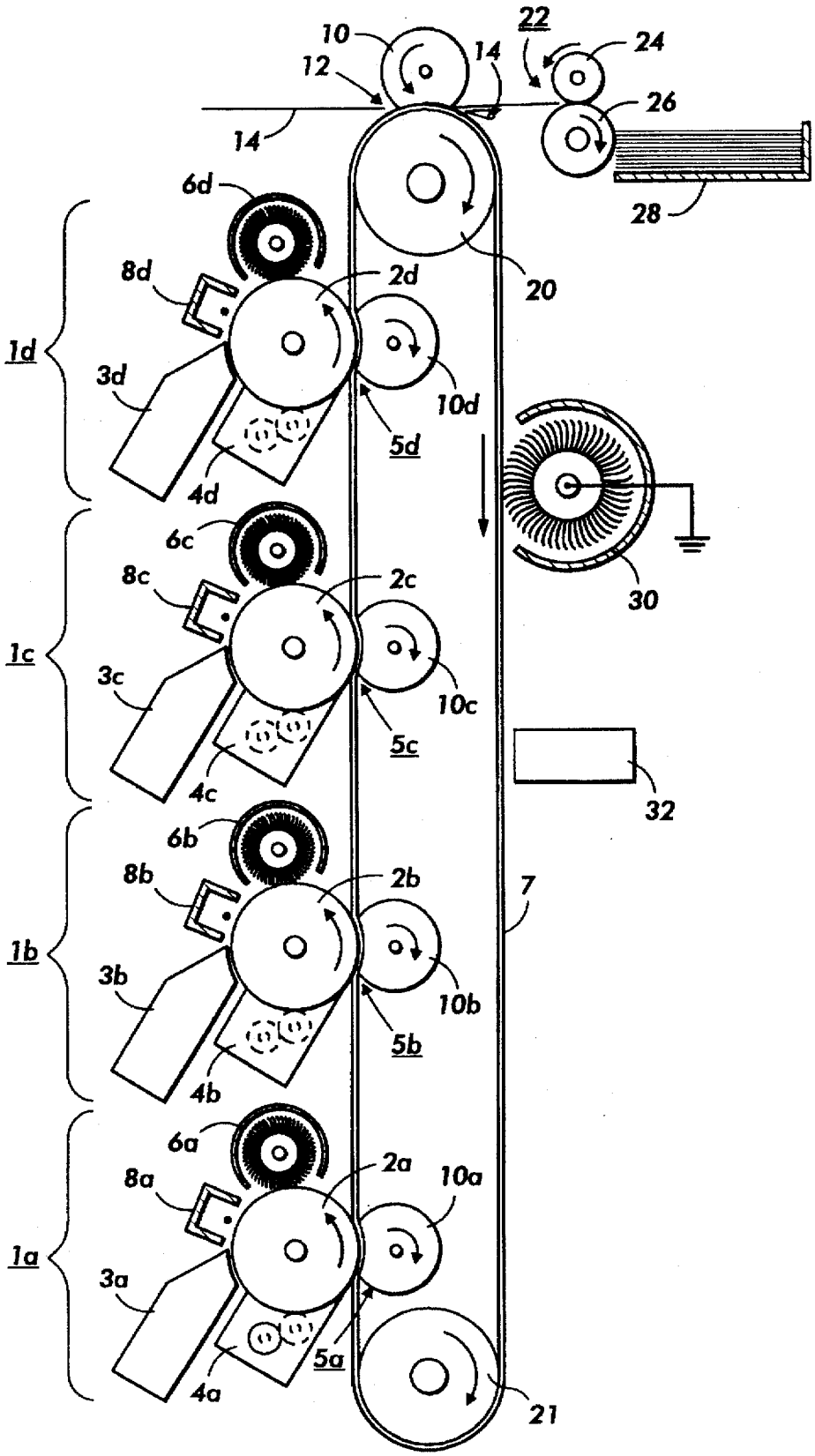
FIG. 1 is a schematic illustration of a color printing apparatus incorporating the inventive features of the invention.

Although specific terms are used in the following description for the sake of clarity, these terms are intended to refer only to the particular structure of the invention selected for illustration in the drawings, and are not intended to define or limit the scope of the invention. A typical color printing apparatus in which the present invention may be used is illustrated in FIG. 1.

In dry electrophotographic printing machines, multicolor copying has been achieved with the utilization of an intermediate roller. In devices of this type, successive toner powder images are transferred in superimposed registration with one another, from the photoconductive drum to an intermediate roller. One such system is described in U.S. Pat. No. 3,957,367 issued to Goel in 1976 which is herein incorporated by reference. In this system, successive toner powder images are transferred from the photoconductive surface to an intermediate roller in superimposed registration with one another. The multicolored image is then transferred to the copy sheet.

In the color electrophotographic apparatus of the present invention, as shown in FIG. 1, four image forming devices 1*a*, 1*b*, 1*c* and 1*d* are utilized. The image forming devices each compromise an image receiving member in the form of photosensitive drum or photoreceptor 2*a*, 2*b*, 2*c* or 2*d* about which are positioned the imaging forming components of the imaging structure. The image receiving members are supported for rotation in the direction of the arrows shown. The image forming devices further comprise exposure structures 3*a*, 3*b*, 3*c* and 3*d*, developing structures 4*a*, 4*b*, 4*c* and 4*d*, soft roll, 5*a*, 5*b*, 5*c* and 5*d*, cleaning structures 6*a*, 6*b*, 6*c* and 6*d* and finally charging structures 8*a*, 8*b*, 8*c* and 8*d*. An intermediate image receiver 7, such as an endless belt, is supported for movement by rollers 20 and 21 in an endless path such that incremental portions thereof move past the image forming devices 1*a*, 1*b*, 1*c* and 1*d* for transfer of an image from each of the image receiving members 2*a*, 2*b*, 2*c* and 2*d*. Each image forming device 1*a* through 1*d* is positioned adjacent intermediate belt 7 for enabling transfer of different color toner images to intermediate belt 7 in superimposed registration with one another. The belt 7 is preferably fabricated from a piezoelectric polymer material, such as, polyvinylidene (PVDF) made by Pennwalt KTM.

The exposure structures 3*a* through 3*d* may be any type of rastor input/output scanning device (RIS/ROS) or any combination using the RIS/ROS devices. The preferred embodiment uses a two level ROS device incorporating a laser. The ROS is a moving spot system that exposes the photoreceptors 2*a* through 2*d* to a light intensity at two levels. Generally, a laser is the light source since it produces a collimated light beam suited for focusing to a small spot, yet with adequate energy to effectively discharge the photoconductors 2*a* through 2*d* which have been previously uniformly charged using the charging structures 8*a* through 8*d*. Charging structures 8*a* through 8*d* may comprise conventional corona discharge devices. The sweep or moving action of the spot is typically obtained by rotating multifaceted mirrors or by reciprocating mirrors attached to galvanometers. Also, a moving spot can be obtained without mechanical devices such as the galvanometer and rotating mirror. An example of a non-mechanical device is an optical defraction member whose internal defraction or reflection properties are varied electrically. Piezoelectric crystals are examples of such devices. An example of a ROS mechanism includes U.S. Pat. No. 4,236,809, herein incorporated by reference.

Figure 4:
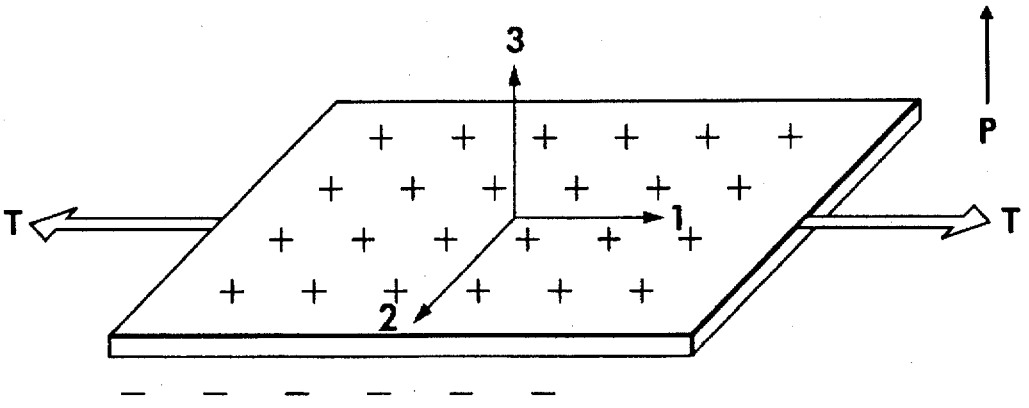
FIG. 4 is a perspective view illustrating the geometry of a piezoelectric sheet.

The belt 7 moves in the clockwise direction as illustrated by the arrow such that each incremental portion thereof first moves past the imaging forming device 1*a*. A yellow image component corresponding to the yellow component of an original is formed on the photoreceptor drum 2*a* using conventional electrophotographic, such as charging structure 8*a*, the exposure structure 3*a* and the developing structure 4*a*. The developer structure develops a yellow toner image on the photoconductive drum 2*a*. The drum rotates in a counterclockwise direction and contacts the belt 7 as shown. Belt 7, in accordance with the present invention, includes an exterior layer of piezoelectric polymer film, such as, polyvinylidene fluoride (PVDF) film, preferably Kynar® film manufactured by Pennwalt KTM. Piezoactive PVDF materials are poled by stretching the film in one direction or biaxially, and applying a large electric field to electrically polarize it in a direction perpendicular to the film. In FIG. 4, the stretch direction is denoted by "1" and the polarization direction is denoted by "3". When poled a PVDF sheet is strained, it develops an internal electric field which is proportional to the deformation. The magnitude and direction of generated fields are determined by mechanical strains and the positioning of an external field neutralization step.

Figure 2:
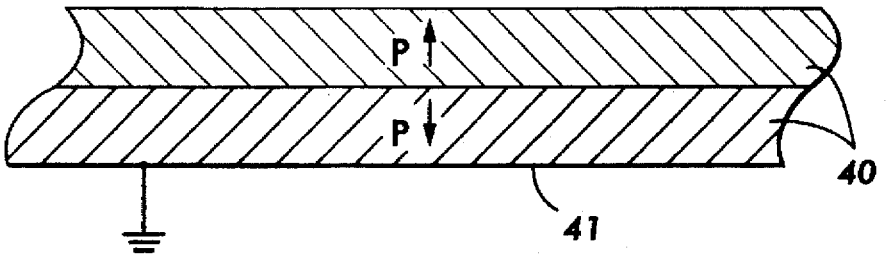
FIG. 2 is an elevational view illustrating a (bimorph) Xeromorph sheet.
Figure 3:
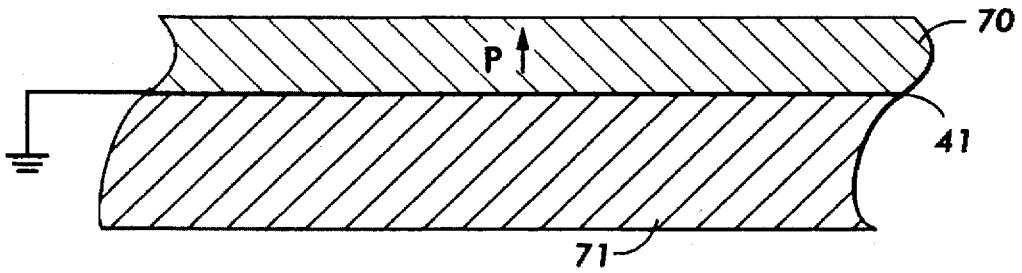
FIG. 3 is an elevational view illustrating a (unimorph) Xeromorph sheet.

The present invention utilizes either a bimorph or unimorph structure referred to as "xeromorph". A bimorph xeromorph as shown in FIG. 2 consists of two PVDF sheets 40 laminated together with sheet polarization direction opposed to each other and having only a bottom electrode 41. A unimorph xeromorph as shown in FIG. 3 consists of a single PVDF sheet 70 laminated to a thick substrate 71 and including an electrode 41. The substrate material may comprise materials which can be bent, and have no piezoelectric properties. Bimorph intermediate member or belt 7 as shown in FIG. 1, is sufficiently elastic and resilient to deform around photoconductors 2*a*, 2*b*, 2*c* and 2*d* and hard roll 20, while making a concave impression into soft rolls 10, 10*a*, 10*b*, 10*c*, and 10*d*. As belt 7 deforms around the radius of the photoconductors and hard roll 20, an electric potential is generated on the surface of the belt 7 due to strain imparted to its piezoelectric constraints. An electric field is thereby created in the nip region formed between the photoconductor 2*a*, and belt 7 causing the yellow image on the photoconductor to transfer over to belt 7. Subsequent to transfer of the yellow image to belt 7, residual yellow toner is removed from the photoconductor 2*a* using cleaning structure 6*a*. Unique advantages of the transfer intermediate system belt 7 include the elimination of needs for high voltage power supplies and corona charging units for the toner transfer steps. Also, since the transfer fields are spatially, not temporally, determined, a single belt design can be expected to function over a wide range of speeds.

In like fashion, a magenta image component corresponding to the magenta component of the original image is formed on the photosensitive drum 2*b* using conventional electrophotographic components such as the charging structure 8*b*, the exposure structure 3*b* and the developing structure 4*b*. The developer structure develops a magenta toner image on the photosensitive drum 2*b*. The drum rotates in the counterclockwise direction and contacts the belt 7 as shown. The transfer structure 5*b* which includes belt 7 and soft roll 10*b* serves to effect transfer of the magenta component of the image at the area of contact between the photosensitive member 2*b* and the belt 7. Subsequent to transfer of the magenta image to the belt 7, residual magenta toner is removed from the drum 2*b* using the cleaning structure 6*b*.

The cyan and black image components corresponding, respectively to the cyan and black components of the original are formed on the photosensitive drums 2*c* an 2*d*, respectively. These images are sequentially transferred to the belt 7 in a superimposed relationship resulting a final toner image comprising three colors plus black. The piezoelectric transfer structures 5*c* and 5*d* were used for image transfer. After transfer of the cyan and black component images, residual toner is removed from the respective image receiving members by cleaning structures 6*c* and 6*d*.

Subsequent to moving past conductor 2*d*, belt 7 is moved through transfer station 12 where the multi-colored image is transferred to a sheet of transfer material or copy sheet 14. The copy sheet 14 is moved into contact with the toner image at transfer station 12. Copy sheet 14 is advanced to the transfer station 12 by conventional sheet feeding apparatus (not shown). Preferably, sheet feeding apparatus includes a feed roll contacting the uppermost sheet of a stack of copy sheets. Feed rollers rotate so as to advance the uppermost sheet from the stack into contact with intermediate belt 7 in a timed sequence so that the toner powder image thereon contacts the advancing copy sheet at transfer station 12. At transfer station 12, and in accordance with the present invention, hard roll 20 bends belt 7 into soft roll 10 to provide good contact between copy sheet 14 and the toner image during transfer and in doing so, the bending of bimorph xeromorph laminated belt 7 into a convex configuration causes a positive strain in the outside layer of the laminate generating a positive voltage opposite to that of the image thereby repulsing the image over to copy sheet 14.

The copy sheet 14 carrying the transferred toner image is passed through the nip 22 of heat and pressure. The fuser 22 comprises a heated fuser roll 24 and a backup roller 26. Copy sheet 14 passes between fuser roller 24 and backup roller 26 with the toner powder image contacting fuser roller 24. In this manner, the toner powder is fixed to the copy sheet. After fusing, a chute (not shown) guides the advancing copy sheet to a catch tray 28 for subsequent removal from the printing machine by the operator.

After the copy sheet 14 is separated from belt 7, the residual toner particles on the surface of belt 7 are removed therefrom. These particles are removed by cleaning apparatus 30 comprising a magnetic brush roll structure for causing carrier particles in the cleaner housing to form brush-like orientation relative to belt 7. Discharge device 32 also neutralizes any residual electrical charge on belt 7 prior to the next imaging cycle. Advantages of this process include increased reliability due to the minimal amount of paper handling required and the more controlled and stable transfer intermediate surface, relative to paper, on which the multiple color toner images can be more accurately registered.

Figure 5:
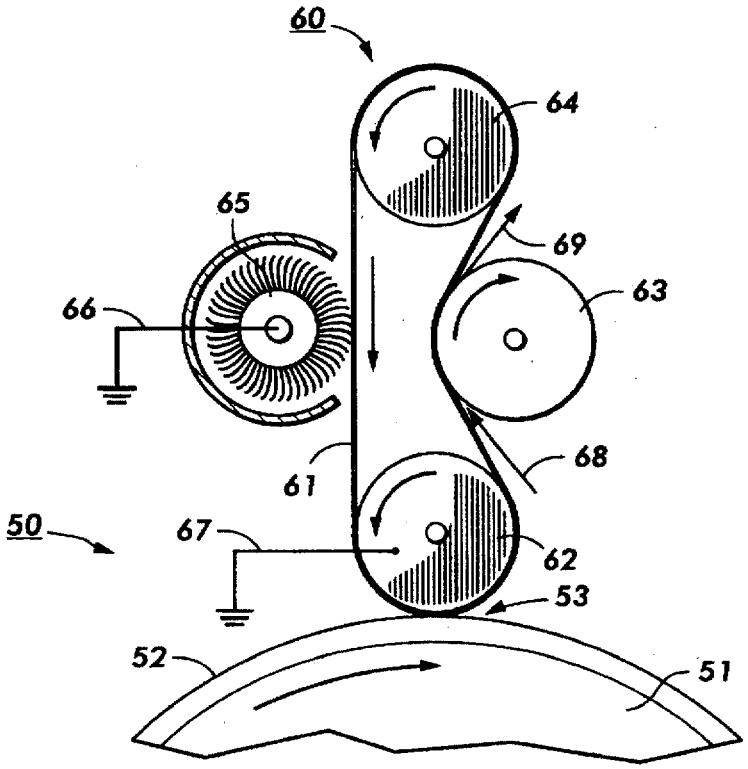
FIG. 5 is a schematic partially illustrating a monochromatic printing apparatus incorporating the inventive features of the invention.

An alternative embodiment of the present invention is shown in FIG. 5 that includes a monochrome imaging machine 50 having a photoconductor 52 overcoated onto a drum 51. A bimorph xeromorph piezoelectric polymer device 60 has a xeromorph transfer intermediate belt 61 that is bimorph in structure as explained hereinbefore. Belt 61 stretched between rollers 62 and 64 is bent into convex contact with photoconductor 52 at transfer nip 53 with an image being transferred from the photoconductor 52 to transfer intermediate belt 61. The image is transferred from transfer intermediate belt 61 to a copy sheet that is conveyed in the direction of arrows 69 into a concaved nip formed between rollers 63 and belt 61. Before approaching transfer nip 53, belt 61 is cleaned and neutralized by brush 65 that is grounded at 66. Roller 62 is grounded at 67 to enhance image transfer from photoconductor 52 to belt 61 at nip 53. Rollers 62, 63 and 64, as well as, drum 51 are rotated in the direction of the arrows.

In operation, piezoelectric belt 61 which is, for example, a polyvinylidene fluoride film (PVDF) is neutralized and cleaned by cleaning brush 65 before it arrives at nip 53. Upon arrival at nip 53, the PVDF material 61 is bent around grounded roller 62 to create an electrical field sufficient to first attract a toner image from the photoconductor 52 to the transfer intermediate PVDF material 61 at transfer nip 53. Subsequently, a change in bending of the PVDF material is caused by roller 63 in a reverse direction to reverse the transfer electric field and repel the toner image onto a copy sheet (not shown) moving in the direction of arrows 69 in order to complete an electrostatic offset process. As with FIG. 1, an advantage of this process is that no high voltage power supplies nor external corotron or biased transfer components are required. Also, the ability to optimally tailor transfer electric fields and the ability to obtain process speed independence are available with this process and the process disclosed with reference to FIG. 1. Process speed independence is attainable since the xeromorph field creation process is geometrically, not temporally determined.

Electrostatic offset transfer to paper using a xeromorph piezoelectric polymer device has been experimentally proven in the following manner: A.) Net surface charge on a bimorph xeromorph element comprising of two bonded and oppositely polarized 110μ thick films of PVDF was neutralized by a conductive (mouse) brush connected to the xeromorph conductive base electrode. B.) The xeromorph was then wrapped onto a 16 mm diameter roll with the electrode surface against the supporting roll. Electrostatic Voltmeter measurements of the potential of the exposed (non-electroded) surface of the xeromorph indicated approximately −700 volts in this (concave) bent condition. C.) The bent xeromorph was then rolled on a developed (+toner charge) image on stencil charged 1 mil aluminized Mylar. Most of the toner adhered to the negative polarity xeromorph surface. D.) The xeromorph was then unwrapped off of the roller and re-wrapped toner side in against paper positioned between the roller and now convex xeromorph. Upon removal of the xeromorph most of the toner image remained (transferred to) on the paper.

While the invention has been described in conjunction with specific apparatuses, it is evident that many alternatives, modifications, and variations will be apparent to those skilled in the art. Accordingly, it is intended to embrace all such alternatives, modifications and variations as fall within the spirit and broad scope of the appended claims.

What is claimed is:

1. Apparatus for forming toner images on an image receiving member and transferring the toner images from the image receiving member to copy sheets, comprising:

at least one image forming device including an image receiving member; and a transfer apparatus including a transfer intermediate member having piezoelectric properties for transferring the images from said image receiving member to said transfer intermediate member and subsequently transferring the images from said transfer intermediate member to copy sheets.

2. The apparatus of claim 1, wherein said transfer intermediate member is in belt form.

3. The apparatus of claims 2, wherein said transfer intermediate belt has piezoelectric properties includes a polyvinylidene fluoride material.

4. The apparatus of claim 3, including a plurality of image forming devices for creating a plurality of images, and wherein said transfer apparatus subsequently transfers said plurality of images to said transfer intermediate belt to form a composite image on said transfer intermediate belt.

5. The apparatus of claim 1, wherein said transfer intermediate member is a web.

6. A method for forming toner images on an image receiving member and transferring the toner images from the image receiving member to copy sheets, comprising:

forming images with at least one image forming device;

placing the images with said image forming device onto an image receiving member;

positioning a transfer apparatus adjacent the image receiving member with said transfer apparatus including a transfer intermediate member having piezoelectric properties for transferring the images from said image receiving member to said transfer intermediate member; and transferring the images from said intermediate member to copy sheets.

7. The method of claim 6 including the step of providing said transfer intermediate member in belt form.

8. The method of claim 7, including the step of providing said transfer intermediate belt with a polyvinylidene fluoride material.

9. The method of claim 8, including the step of providing a plurality of image forming devices for creating a plurality of images, and using said transfer apparatus to subsequently transfer said plurality of images to said transfer intermediate belt to form a composite image on said transfer intermediate belt.

10. The method of claim 6, including the step of configuring said transfer intermediate member as a web.

11. A device for transferring images from an imaged source to a copy sheet, comprising:

a transfer intermediate member, and wherein said transfer intermediate member includes piezoelectric properties for transferring the images from the imaged source to said intermediate member and subsequently transferring the images from said intermediate member to copy sheets.

12. The device of claim 11, wherein said intermediate member is in belt form.

13. The device of claim 12, wherein said intermediate belt having piezoelectric properties includes a polyvinylidene fluoride material.

14. The device of claim 11, wherein said transfer intermediate member is a web.

15. The device of claim 13, wherein said intermediate belt comprises two polyvinylidene fluoride sheets laminated together with sheet polarization directions opposed to each other and an electrode attached to a surface of one of said sheets.

* * * * *